United States Patent [19]

Hoag et al.

[11] Patent Number: 4,573,993

[45] Date of Patent: Mar. 4, 1986

[54] FLUID TRANSFER APPARATUS

[75] Inventors: Robert E. Hoag, Irvine; Axel Mnich, Fallbrook, both of Calif.

[73] Assignee: Instafil, Inc., Irvine, Calif.

[21] Appl. No.: 537,055

[22] Filed: Sep. 29, 1983

[51] Int. Cl.[4] ..... A61J 1/00

[52] U.S. Cl. ..... 604/411; 604/414; 604/905; 604/192

[58] Field of Search ..... 604/403, 411–414, 604/251–254, 262, 263, 905, 192; 222/81–83; 141/329, 330, 310

[56] References Cited

U.S. PATENT DOCUMENTS

| | | | |
|---|---|---|---|
| 2,682,874 | 7/1954 | Hickey | 128/214.2 |
| 2,825,333 | 3/1958 | Broman | 128/214 R |
| 3,034,504 | 5/1962 | Winsor et al. | 604/254 |
| 3,135,259 | 6/1964 | Evans | 128/214 R |
| 3,329,146 | 10/1963 | Waldman, Jr. | 604/192 |
| 3,608,550 | 9/1971 | Stawski | 604/414 |
| 3,788,369 | 1/1974 | Killinger | 128/272.3 X |
| 3,885,607 | 5/1975 | Peltier | 604/413 |
| 3,941,171 | 3/1976 | Ogle | 141/309 |
| 4,058,121 | 11/1977 | Choksi et al. | 128/221 |
| 4,369,781 | 1/1983 | Gilson et al. | 604/905 |
| 4,505,709 | 3/1985 | Froning | 604/411 |
| 4,507,113 | 3/1985 | Dunlap | 604/411 |

*Primary Examiner*—John D. Yasko
*Assistant Examiner*—Karen Kaechele
*Attorney, Agent, or Firm*—Fulwider, Patton, Rieber, Lee & Utecht

[57] ABSTRACT

Fluid transfer apparatus particularly adapted for injecting a quantity of fluid from a fluid source into a stoppered vial containing material in lyophilized form. The apparatus comprises a cannula having a distal extremity for piercing the vial stopper and a handle mounted to the cannula to facilitate insertion and withdrawal of the cannula. An occlusion clamp is carried by the handle in position to control fluid flow through tubing extending from the cannula and through the handle for connection to the fluid source. The cannula and handle include interengageable elements movable relative to each other for rapid coupling and decoupling to enable demounting of the cannula and mounting of a replacement cannula. An indexing and stop system enables proper orientation of the cannula relative to the handle. The cannula replacement is conveniently sealed within a cap and wrench section to maintain sterility, the wrench section on separation from the cap being engagable with the replacement cannula to facilitate its rotation relative to the handle to mount the cannula to the handle.

15 Claims, 14 Drawing Figures

FIG. 2
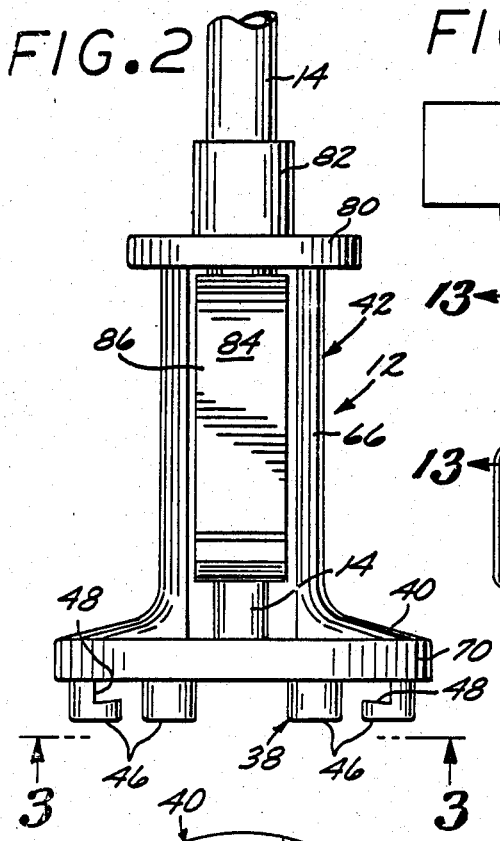
FIG. 1
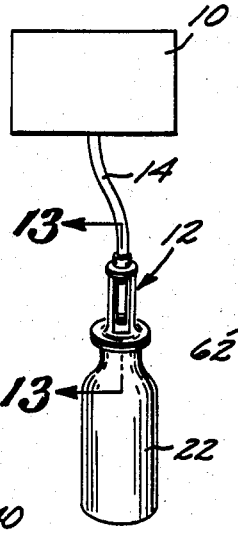
FIG. 4
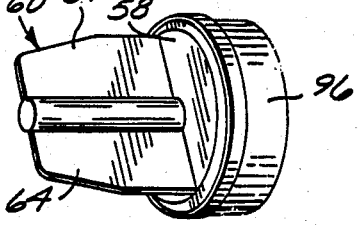
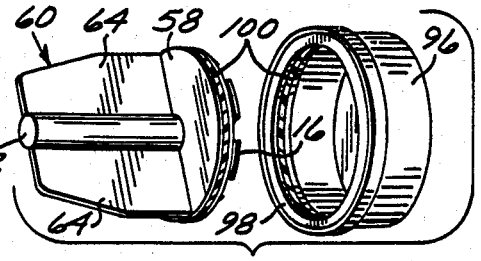
FIG. 5
FIG. 6
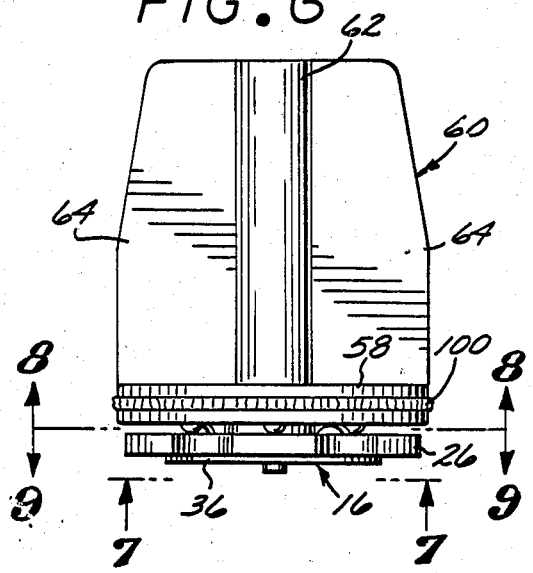
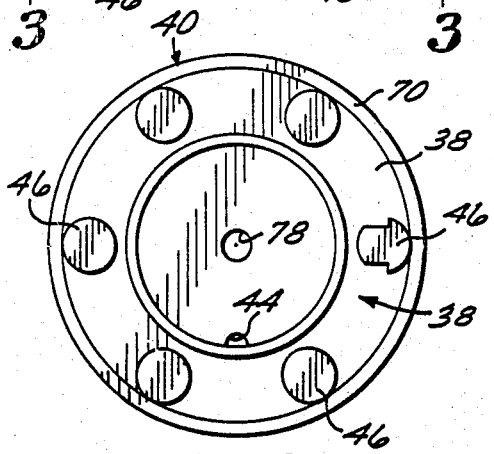
FIG. 3
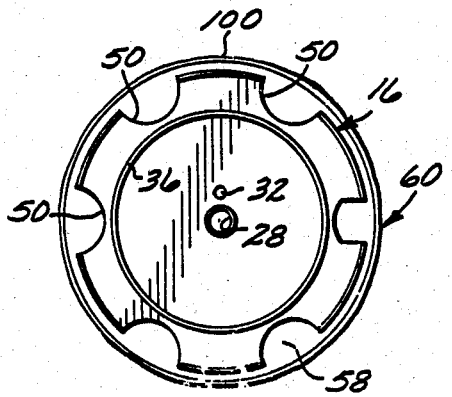
FIG. 7
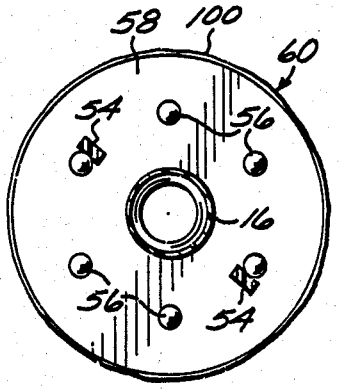
FIG. 8
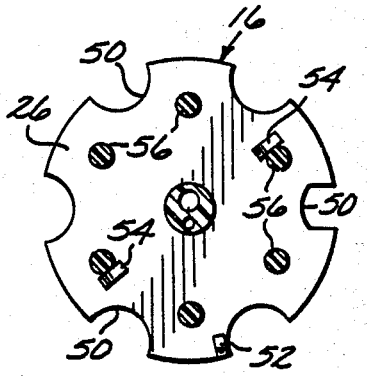
FIG. 9

FLUID TRANSFER APPARATUS

BACKGROUND OF THE INVENTION

1. Field of the Invention

The present invention relates to fluid transfer apparatus for introducing sterile liquid or the like into a vessel at a controlled rate.

2. Description of the Prior Art

The pharmacies of large hospitals are often called upon to provide many doses of a particular medicament or drug within a relatively short period of time. Such drugs are commonly provided by drug companies in rubber stoppered vials in dry or lyophilized powder form. It is necessary for the pharmacy to fill the vials to a predetermined level with a sterile liquid to dissolve the powder for administration of the drug through the usual intravenous or IV equipment.

A means is necessary for rapidly and efficiently injecting sterile liquid successively into a plurality of stoppered vials, and without contamination of the contents of the vial, such as would occur if the stopper were removed and the sterile liquid simply poured into the vial.

Various prior art fluid transfer means for filling such drug vials have been advanced. In one system the rubber stopper of the vial includes a ridge to show where the filling needle is to be inserted, and another to indicate where a vent needle is to be inserted. A predetermined quantity of the sterile liquid is then gravity fed into the vial through the filling needle. This proved to be extremely time consuming because both the filling and vent needles had to be separately withdrawn from each vial and reinserted into the next vial, all the while shifting the filling equipment down the line of vials to be filled.

In another prior art system, the sterile liquid was introduced into the vial under pressure by a syringe. However, this left a residual pressure in the vial which adversely affected subsequent precision dispensing of drugs from the vial. This problem of residual pressure was eliminated by yet other systems employing a filling needle having a venting passage. U.S. Pat. Nos. 3,941,171, issued Mar. 2, 1976 and 4,058,121, issued Nov. 15, 1977 are typical of these types of system.

In the first of these patents the opposite extremities of a filling needle were inserted into a filled vial and an empty vial, respectively, the empty vial venting into the filled vial as the filling process took place. This gravity feed principal was undesirably slow. In the second patent, a filling needle was used to vent the vial as filling took place, but the sterile liquid injected was drawn periodically from a conventional syringe. This involved a number of tedious and repetitive steps ill suited for rapidly filling large numbers of vials. Also, the capacity of the syringe was such that it had to be replenished quite often by withdrawal of liquid from some larger fluid source. When this was done atmospheric air would flow through the needle vent passage into the fluid source container, necessitating a contaminant filter in the passage to prevent contamination of the sterile liquid. Finally, the syringe was not well suited to sensitive control of the rate of filling of a vial.

A problem not met by the devices of the prior art is the frequent need to fill successive stoppered vials containing different medications with solution. Previously, in order to avoid cross-contamination, different fluid transfer apparatuses had to be substituted between batches of different medications.

SUMMARY OF THE INVENTION

According to the present invention, a fluid transfer apparatus is provided which comprises a cannula having a distal extremity adapted to pierce the stopper of a vial into which fluid is to be transferred, and a proximal extremity adapted for connection by tubing to a source of fluid. The cannula includes a filling passage for conveying fluid into the vial from the tubing, and a vent passage for venting the vial as the vial is being filled.

The fluid source is preferably a pressurizable source such as a flexible or collapsible bag encompassed by an inflatable cuff.

The base of a handle is separably attached to the cannula, the handle including openings and passages through which the tubing extends. An occlusion clamp adjacent the handle includes inner and outer portions between which the tubing passes. The outer portion projects outwardly of the handle and when pressed inwardly adjustably slows or cuts off fluid flow through the tubing.

The distal end of the fluid passage in the cannula opens generally laterally and preferably on the same side as the clamp outer portion. This generally inclines and upwardly orients the discharge opening of the fluid passage when the cannula pierces the vial stopper, tending to prevent undesirable coring of the material of the stopper.

To fill a succession of vials, it is only necessary to pierce the vial stopper, manipulate the clamp to regulate the rate and duration of filling, withdraw the cannula and immediately insert it into the next vial. A regulated level of fluid pressure is easily maintained throughout the filling operation by periodically squeezing a pressurizing bulb of the inflatable cuff.

Attachment means are provided on the complemental faces of the cannula base and the handle base. These are operative upon relative rotation of the bases to attach the cannula to the handle. Indexing and locking means are preferably provided to insure mounting of the cannula to the handle in a position in which the distal end of the fluid passage in the cannula opens on the same side as the clamp outer portion. This properly orients the fluid passage to reduce the possibility of coring of the vial stopper upon insertion of the cannula.

On demounting of the cannula a replacement cannula can quickly be fitted to the handle. Each replacement cannula preferably is part of a cannula set, the cannula being disposed within an elongated receptacle of a wrench means. The wrench means includes a circular wrench section adapted to interengage the cannula base on removal of the cannula from the elongated receptacle for turning and mounting the cannula upon the handle. The cannula replacement set also includes a sealing cap attachable to the wrench means for enclosing the cannula and thereby maintaining sterility.

Other objects and features of the invention will become apparent from consideration of the following description taken in connection with the accompanying drawings.

BRIEF DESCRIPTION OF THE DRAWINGS

FIG. 1 is an elevational view of the present fluid transfer apparatus mounted to a vial;

FIG. 2 is an enlarged elevational view of the handle including the separable insert or base;

FIG. 3 is a view taken along the line 3—3 of FIG. 2;

FIG. 4 is a perspective view of a cannula replacement set comprising a wrench and cap enclosing the cannula;

FIG. 5 is an exploded view of the components of FIG. 4;

FIG. 6 is an enlarged front elevational view of the wrench and cannula of FIGS. 4 and 5;

FIG. 7 is a view taken along the line 7—7 of FIG. 6;

FIG. 8 is a view taken along the line 8—8 of FIG. 6;

FIG. 9 is a view taken along the line 9—9 of FIG. 6;

DESCRIPTION OF THE PREFERRED EMBODIMENT

Figure 13:
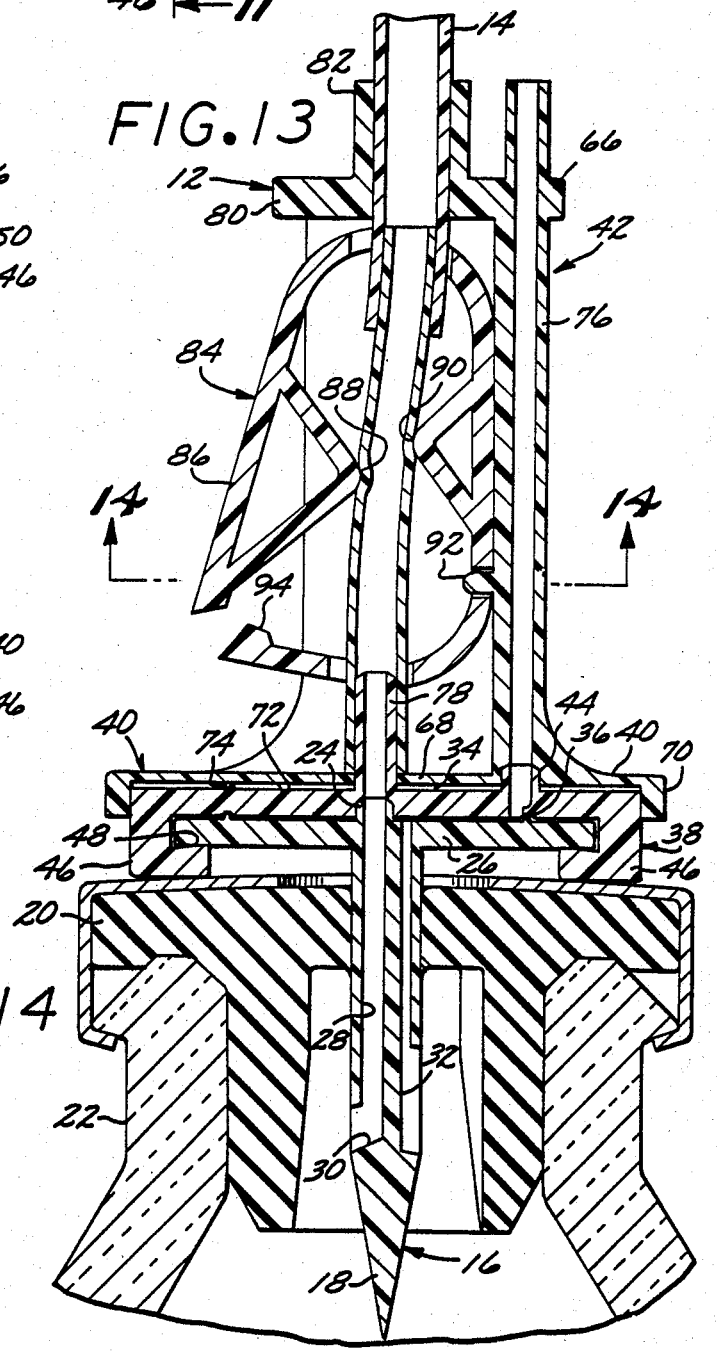
FIG. 13 is an enlarged longitudinal cross-sectional view of the structure of FIG. 1.

Referring now to the drawings, and particularly to FIGS. 1 and 13, there is diagrammatically illustrated a source 10 of sterile liquid. Any suitable means for pressurizing the sterile liquid may be employed, such as by using a collapsible bag (not shown) as the fluid source and squeezing liquid out of the bag at a controlled pressure through use of an inflatable cuff of a type well known in the prior art.

Other means for providing pressurized sterile liquid may be used, such as a peristaltic pump. Alternatively, liquid may be induced to flow into the vial to be filled by utilizing a vacuum pump to reduce pressure in the vial, as will be apparent.

The source 10 is connected to the present fluid transfer means or apparatus 12 by a flexible conduit or tubing 14.

The transfer apparatus 12 includes a needle, spike or cannula 16 having a distal extremity 18 adapted to pierce the rubber stopper 20 of a vial 22 containing a drug (not shown), and into which fluid is to be transferred. The cannula 16 further has a proximal extremity 24 and a circular, laterally extending cannula base 26 located adjacent the proximal extremity 24.

The cannula 16 includes a filling passage 28 extending from its proximal extremity 24 to its distal extremity 18, terminating in a generally laterally oriented, oval discharge opening 30.

The cannula 16 also includes a vent passage 32 which vents the vial 22 through the cannula base 26. The lower or distal end of the vent passage 32 includes a slot which opens laterally and oppositely of the discharge opening 30. The upper end of the vent passage 32 extends through the cannula base 26 and opens into a plenum chamber 34 defined by the upper face of the cannula base 26, by a ridge 36 projecting upwardly of the cannula base upper face, and by the underface of a base insert 38. As will be seen, the base insert 38 is part of a handle base 40 which forms a part of a handle 42. With this arrangement any air vented from the vial 22 passes through the vent passage 32, into the plenum chamber 34 and, as will be seen, upwardly through a tubular projection 44 of the handle 42 in communication at its lower end with the plenum chamber 34.

The base insert 38 is circular and includes a plurality of depending retaining elements 46 equally spaced about its circumference. Each element 46 is formed as a column or post of circular cross section depending from the main body of the insert 38. The radially inward, upper portion of each post or element 46 is cut away or formed to define a radially inwardly directed ledge which with the upper recessed portion of the element 46 forms a recessed seat 48.

The cannula base 26 includes arcuate edge recesses 50 equal in number to the elements 46, and equally spaced apart about the circumference of the cannula base 26. The recesses 56 are adapted to fit over the elements 46 to seat the ridge 36 of the cannula base 26 into the complemental groove in the underface of the base insert 38.

One of the edge recesses 50 is smaller and rectangular in configuration, and the lower portion of one of the retaining elements 46 is cut away or formed into a rectangular configuration so that the rectangular edge recess 50 will fit over it, and no other. Thus, the cannula base 26 is indexed so that it can be mounted upon the base insert 38 in only one circumferential position.

Once properly indexed or positioned with the rectangular edge recess 50 fitted over the smaller, rectangularly configured retaining element 46, the cannula base 26 is rotatable clockwise relative to the base insert 38. This disposes the circumferential portions of the cannula base 26 located between the edge recesses 50 in engagement with the ledge portions of the recessed seats 48, and prevents axial separation of the cannula 16 from the base insert 38. To provide this interrelationship, the outer circumference of the base insert 38 is generally coincident with the circumference of the insert 38 which passed through the inner faces of the edge recesses 50.

Figure 10:
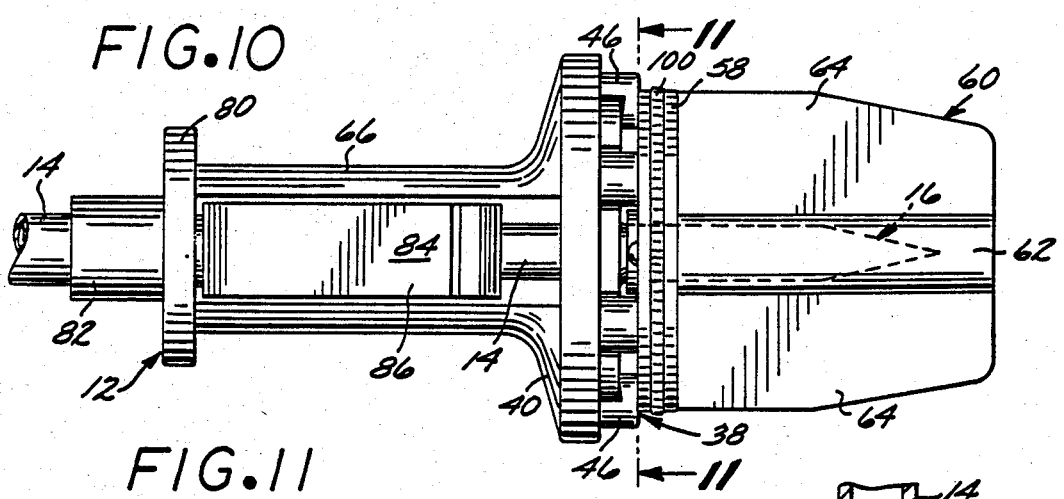
FIG. 10 is an elevational view of the wrench of FIG. 6 as it would appear during mounting of the cannula to the handle assembly.
Figure 11:
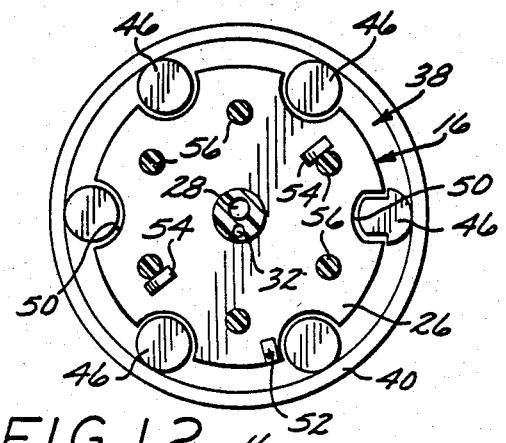
FIG. 11 is a view taken along the line 11—11 of FIG. 10.
Figure 12:
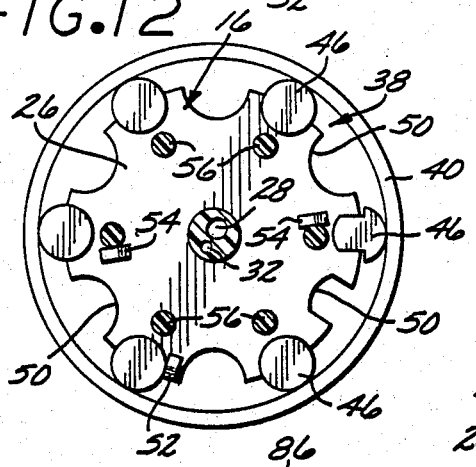
FIG. 12 is a view similar to FIG. 11, but illustrating the cannula rotated into seated position.

Rotation of the cannula base 26 relative to the base insert 38 beyond the position just described is prevented by a depending projection or stop 52, as best seen in FIG. 12, which engages the ledge portion of one of the recessed seats 48.

The relative positions of the cannula 16 and insert 38, as will be seen, is effective to locate the discharge opening 30 of the cannula 16 in a predetermined position relative to the base insert 38 which facilitates insertion of the cannula 16 in the stopper 20, and contemporaneous control of the filling fluid flow.

Turning of the cannula base 26 relative to the base insert 38 to reach the position illustrated is facilitated by exerting torque upon a pair of wrench tabs 54 provided on the underside of the cannula base 26. The tabs 54 are conveniently engageable by complemental wrench tabs 56 which project from the underface of the circular wrench section or base 58 of a wrench 60, as best seen in FIGS. 4 through 9.

The opposite side of the wrench base 58 includes an elongated tubular portion which defines an internal bore or receptacle 62 into which the needle portion of the cannular 16 is adapted to fit in frictional engagement during engagement between the wrench tabs of the wrench 60 and the cannula 16. Wing portions or grips 64 extend radially outwardly from the tubular portion of the wrench 60 to make it easier to rotate. As will be seen, the wrench 60 also forms part of a cannula replacement set.

The handle 42 includes a handle body 66 having a circular flange or base wall 68 provided with a depending rim 70 which defines a circular recess 72. The base insert 38 fits within the recess 72 with its circumferential edge margin against the inner face of the rim 70. The handle body 66 and insert 38 fit together in only one circumferential position because of the provision of the tubular projection 44, which extends into an elongated tab 76 integral with the handle body 66.

An upwardly oriented circular ridge 74 is provided on the upper face of the base insert 38 for engagement with the underside of the base wall 68. The base insert 38 is preferably made integral with the handle 66 by sonically welding the plastic material of the ridge 74 so that it fuses with the adjacent face of the base wall 68. If desired, the base insert 38 could be molded or otherwise formed as an integral part of the handle 66, but the arrangement described has been found to be more practical and economical to produce.

A fluid filling passage is provided in the center of the base insert 38 for fluid communication with the cannula filling passage 28. Its upper extremity is defined by a tubular portion 78 which extends upwardly through a central opening in the handle base 40 for connection to tubing which may form a part of the tubing 14 or which for convenience, may be a smaller diameter, shorter length section of more flexible tubing, as illustrated.

With the cannula 16 assembled to the handle 66, the lower faces of the retaining elements 46 are in position to engage the upper surface of the stopper 20, as seen in FIG. 13. As seen, the upper face of the handle base wall 68 provides a generous surface area which the user can employ to thrust the cannula 16 downwardly through the stopper 20.

The handle 66 is hollow, elongated and generally cylindrical, its walls defining an enclosure or cage which is open on one side. The upper end of the enclosure is closed by an upper wall 80 having a cylindrical conduit 82 through which the tubing 14 extends.

Tubing carries fluid from the fluid source 10, through the tubing 14, through the filling passages of the base insert 38 and to the cannula 16 for discharge out of the opening 30. The interior of the vial 22 is vented through the vent passage 32, into the plenum chamber 34, and out through the handle tube 76.

Figure 14:
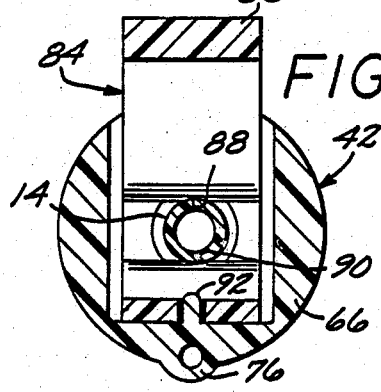
FIG. 14 is a view taken along the line 14—14 of FIG. 13.

A loop shaped occluding means, element or clamp 84 made of resilient plastic material is received or fitted within the enclosure defined within the hollow interior of the handle 66, as best seen in FIGS. 13 and 14. The outer portion of the loop configuration is discontinuous to define a lever portion 86 biased or projected outwardly. Inwardly located opposed portions of the clamp 84 define confronting, vertically offset inner surfaces 88 and 90 between which the tubing 14 extends. The surfaces 88 and 90 are adapted to squeeze the tubing 14 to obstruct fluid flow. Although use of the clamp 84 is preferred, it will be apparent that various other occluding means may be employed, if desired.

The inner walls of the handle 66 include a locating protuberance 92 which extends into a complemental opening in the handle 66 to properly locate it in the handle 66.

In operation, the vial stopper 20 is swabbed with isopropyl alcohol or the like, the handle 66 is grasped in one hand, and the vial 22 is held in the opposite hand or held upon a supporting surface. The cannula 16 is preferably slightly inclined to upwardly orient the discharge opening 30, and the distal extremity 18 is thrust downwardly and inwardly in an arcuate motion to pierce the stopper 20 in a thrust path directed away from the opening 30 to substantially eliminate coring of the stopper 20. The fingers can be placed upon the upper surface of the handle base wall 68 to facilitate the piercing motion.

During such piercing, the thumb can be conveniently pressed against the outwardly projecting lever portion 86, causing the inner surfaces 88 and 90 to engage upon the adjacent tubing 14 and occlude or obstruct fluid flow through the tubing 14. A locking detent 94 may be employed to positively lock the lever portion 86 in its inward position, if desired. The indexed positions of the assembled handle body 66, base insert 38 and cannula 16 insure that the discharge opening 30 and clamp 84 are located on the same side, which avoids coring of the stopper 20 and also facilitated easy control of the fluid filling.

When the retaining elements 46 are engaged upon the upper surface of the stopper 20, the lever portion 86 is released. Its bias action moves it outwardly, and fluid from the fluid source 10 flows into the vial 22, air being vented by means of the vent passage 32 and tube 76. As previously indicated, the fluid source 10 is preferably pressurized by a pressurizable bag or cuff, although a peristaltic pump could also be utilized if desired. In either event the air is vented to atmosphere through the tube 76. However, if a nonpressurized fluid source is used in conjunction with a vacuum pump (not shown), the pump is attached to the tube 76. Thus, the present apparatus 12 is adapted for use with any of these three arrangements.

When the vial 22 is filled close to the desired level, the lever portion 86 is moved inwardly to slow fluid flow, and then shut it off altogether when the proper fluid level is reached. The cannula 16 is then withdrawn and quickly inserted into the next vial.

In the event that the cannula 16 becomes dull through extended use, or it is desired to fill vials 22 containing different materials, the cannula 16 is easily demounted from the handle 42 by using the wrench 60, as previously described.

A replacement cannula 16 is preferably carried in a wrench 60 as part of a replacement set. As previously indicated, the needle portion of the cannula 16 fits within the wrench receptacle 62. The circumferential edge of the wrench base 58 fits upon the circumferential ledge 98 of a cylindrical cap 96. A thin connecting web of plastic material extends between the complemental edges of the wrench base 58 and the cap ledge 98 to seal the replacement cannula 16 from outside contaminants.

The sterile cannula 16 is removable from the cap 96 by pressing downwardly upon the wrench 60. This severs the thin connecting web, the remnants of the web being indicated at 100 in FIG. 5.

The cannula 16 is then usable with the handle 42 in the manner previously described. Thus, the replacement cannula 16, wrench 60 and cap 96 form a convenient replacement set to enable rapid change of a cannula 16 with a sterile replacement cannula 16.

Various modifications and changes may be made with regard to the foregoing detailed description without departing from the spirit of the invention.

We claim:

1. Fluid transfer apparatus comprising:

a cannula including a proximal extremity and a distal extremity adapted to extend into a vessel into which fluid is to be transferred, said cannula having cannula attachment means adjacent said proximal extremity, a distal filling passage and a distal vent passage;

a handle including a handle base having handle attachment means coupled to said cannula attachment means for mounting said cannula to said handle, said handle including a proximal filling passage in fluid communication with said distal filling passage for conveying fluid into said vessel, and an elongated tubular conduit defining a proximal vent passage in fluid communication at one extremity with said distal vent passage and open at its opposite extremity for venting said vessel to atmosphere or for connection to the conduit of a vacuum system for venting into the vacuum system, said cannula attachment means and said handle attachment means being movable relative to each other for rapid coupling and decoupling to enable mounting and demounting of said cannula relative to said handle and mounting of a replacement cannula;

flexible conduit means coupled at one extremity to said proximal filling passage and extending through said handle, said conduit means being adapted for connection at its opposite extremity to a source of fluid; and occluding means carried by said handle and operative to control fluid flow through said conduit means.

2. Fluid transfer means according to claim 1 wherein said cannula includes a cannula base engaged upon said handle base and defining a plenum chamber therebetween in fluid communication with said proximal vent passage and said distal vent passage.

3. Fluid transfer means according to claim 2 wherein said cannula base and said handle base include confronting, complementally interengaged and circumferentially continuous fluid sealing means to prevent air passage to or from said plenum chamber other than through said distal or proximal vent passages.

4. Fluid transfer apparatus according to claim 1 wherein said retaining elements and said edge recesses include indexing means enabling location of said cannula base on said handle base in a single mounted position whereby said distal filling passage is located in predetermined relation to said handle.

5. Fluid transfer apparatus according to claim 1 wherein one of said retaining elements comprises a specially configured indexing element and one of said edge recesses comprises a specially configured indexing recess adapted to complementally fit over said indexing element, and not over the remaining ones of said retaining elements, to enable location of said cannula base on said handle base in a single mounted position whereby said distal filling passage is located in predetermined relation to said handle.

6. Fluid transfer apparatus according to claim 4 and including stop means on said cannula base adapted to engage at least one of said retaining elements to prevent turning of said cannula base relative to said handle base beyond a position in which said distal filling passage is located in said predetermined relation.

7. Fluid transfer apparatus according to claim 1 wherein said handle base is formed separately of the remainder of said handle and is permanently attached thereto to define therewith a plenum chamber in fluid communication with said proximal vent passage.

8. Fluid transfer apparatus according to claim 1 wherein said cannula base includes on its distal face wrench engaging means adapted for engagement by a wrench to facilitate said turning.

9. Fluid transfer apparatus comprising a cannula including a proximal extremity and a distal extremity adapted to extend into a vessel into which fluid is to be transferred, a distal filling passage, a distal vent passage, and a circular cannula base having a plurality of edge recesses spaced about its circumferential edge; and a handle including a circular handle base having a plurality of retaining elements defining recessed seats adapted to receive the circumferential edge of said cannula base in a mounted position, wherein said recesses are located between said retaining elements whereby turning said cannula base relative to said handle base to align said retaining elements with said recesses enables demounting of said cannula from said handle.

10. Fluid transfer apparatus according to claim 9 wherein said cannula base and said handle base define a plenum chamber in communication with said distal vent passage.

11. Fluid transfer apparatus according to claim 9 wherein said retaining elements and said edge recesses include indexing means enabling location of said cannula base on said handle base in a single mounted position whereby said distal filling passage is located in predetermined relation to said handle.

12. Fluid transfer apparatus according to claim 9 wherein one of said retaining elements comprises a specially configured indexing element and one of said edge recesses comprises a specially configured indexing recess adapted to complementally fit over said indexing element, and not over the remaining ones of said retaining elements, to enable location of said cannula base on said handle base in a single mounted position whereby said distal filling passage is located in predetermined relation to said handle.

13. Fluid transfer apparatus according to claim 11 and including stop means on said cannula base adapted to engage at least one of said retaining elements to prevent turning of said cannula base relative to said handle base beyond a position in which said distal filling passage is located in said predetermined relation.

14. In fluid transfer apparatus including a cannula having a cannula base for mounting to a handle base of a handle by partial rotation of said cannula base relative to said handle base whereby fluid may be transferred from a fluid source to a vessel through said handle, an improved cannula set comprising:

a cannula including a disk shaped flange constituting a cannula base, and further including a needle having a filling passage and a vent passage extending through said cannula base for fluid communication with filling and venting passages in said handle, said cannula base having a plurality of circumferentially spaced apart protuberances constituting wrench tabs;

a wrench including a disk shaped flange constituting a wrench base, and further including an elongated receptacle extending through said wrench base and receiving said needle, the face of said wrench base confronting said cannula base having lugs interengaged upon at least a pair of said wrench tabs to enable turning of said cannula by turning of said wrench whereby said cannula base may be turned relative to said handle base for mounting said cannula to said handle; and a cylindrical cap closed at one end and sealably engaged upon the circumference of said wrench base and maintaining said cannula in sterile condition prior to separation of said cannula from said cap and said wrench.

15. Fluid transfer apparatus comprising:

a cannula including a proximal extremity and a distal extremity adapted to extend into a vessel into which fluid is to be transferred, said cannula including a circular cannula base having circumferentially spaced apart edge portions and edge recesses adjacent said proximal extremity, said cannula further including a distal filling passage and a distal vent passage;

a handle including a circular handle base having a plurality of circumferentially spaced apart retaining elements having recessed seats, respectively, receiving said edge portions of said cannula base for mounting said cannula to said handle, said handle including a proximal filling passage in fluid communication with said distal filling passage for conveying fluid into said vessel, and a proximal vent passage in fluid communication with said distal vent passage for venting said vessel, said retaining elements being adapted for alignment with said edge recesses of said cannula base upon rotation of said cannula base relative to said handle base for demounting of said cannula relative to said handle and mounting of a replacement cannula;

flexible conduit means coupled at one extremity to said proximal filling passage and extending through said handle, said conduit means being adapted for connection at its opposite extremity to a source of fluid; and occluding means carried by said handle and operative to control fluid flow through said conduit means.

* * * * *

UNITED STATES PATENT AND TRADEMARK OFFICE

CERTIFICATE OF CORRECTION

PATENT NO. : 4,573,993

DATED : March 4, 1986

INVENTOR(S) : Robert E. Hoag

It is certified that error appears in the above-identified patent and that said Letters Patent is hereby corrected as shown below:

Column 5, line 36, after "Tubing" insert --14--;

Column 7, lines 36, 42 & 63, delete "1" and insert --15--; and line 66, delete "turning" and insert --rotation--.

Signed and Sealed this

*Eighth* Day of *July 1986*

[SEAL]

*Attest:*

DONALD J. QUIGG

*Attesting Officer*

*Commissioner of Patents and Trademarks*